US007703794B2

(12) United States Patent
O'Hara

(10) Patent No.: US 7,703,794 B2
(45) Date of Patent: Apr. 27, 2010

(54) CANTING DEVICE FOR A SNOWBOARD BINDING AND METHODS

(76) Inventor: Steve O'Hara, 234 NW. 22nd Ave., Camas, WA (US) 98607

( * ) Notice: Subject to any disclaimer, the term of this patent is extended or adjusted under 35 U.S.C. 154(b) by 881 days.

(21) Appl. No.: 11/459,830

(22) Filed: Jul. 25, 2006

(65) Prior Publication Data

US 2007/0029759 A1 Feb. 8, 2007

Related U.S. Application Data

(60) Provisional application No. 60/705,627, filed on Aug. 3, 2005.

(51) Int. Cl.
*A63C 9/00* (2006.01)

(52) U.S. Cl. ..... 280/618; 280/636

(58) Field of Classification Search ..... 280/617, 280/618, 623, 634, 636, 14.21, 14.22, 14.24
See application file for complete search history.

(56) References Cited

U.S. PATENT DOCUMENTS

| | | | | |
|---|---|---|---|---|
| 3,675,938 | A | 7/1972 | Sigl | |
| 3,917,298 | A | 11/1975 | Haff | |
| 5,172,924 | A * | 12/1992 | Barci | 280/14.22 |
| 5,299,823 | A | 4/1994 | Glaser | |
| 5,503,900 | A | 4/1996 | Fletcher | |
| 5,803,467 | A * | 9/1998 | Piotrowski | 280/7.14 |
| 5,855,390 | A | 1/1999 | Hassell | |
| 5,909,894 | A | 6/1999 | Meader et al. | |
| 5,915,718 | A | 6/1999 | Dodge | |
| 6,068,283 | A | 5/2000 | Couderc et al. | |
| 6,328,328 | B1 | 12/2001 | Finiel | |
| 6,641,163 | B2 * | 11/2003 | Joubert des Ouches | 280/624 |
| 6,644,681 | B2 | 11/2003 | Couderc et al. | |
| 6,655,700 | B1 | 12/2003 | Caputo et al. | |
| 6,705,633 | B2 * | 3/2004 | Poscich | 280/618 |
| 6,715,773 | B2 | 4/2004 | Aiken | |
| 6,808,196 | B2 | 10/2004 | Des Ouches | |
| 7,073,813 | B2 | 7/2006 | Martin et al. | |
| 2003/0094777 | A1 | 5/2003 | Fournier | |
| 2004/0100069 | A1 | 5/2004 | Cumby | |
| 2004/0119265 | A1 | 6/2004 | Draper et al. | |
| 2004/0201203 | A1 | 10/2004 | Karol | |
| 2004/0227311 | A1 | 11/2004 | Sanders | |
| 2004/0232656 | A1 | 11/2004 | Gyr | |
| 2006/0290106 | A1 | 12/2006 | Orr et al. | |

* cited by examiner

*Primary Examiner*—Frank B Vanaman
(74) *Attorney, Agent, or Firm*—Ganz Law, P.C.

(57) ABSTRACT

Embodiments of a canting device for use with a snowboard system are described herein. According to one exemplary embodiment, a snowboard system includes a snowboard, a snowboard binding mountable on the snowboard, and an adjustable canting device positionable at least partially within the binding such that the binding is positioned between the snowboard and the adjustable canting device. The canting device can be configured to selectively cant a snowboard boot relative to the binding and the snowboard when the snowboard boot is secured in the binding.

32 Claims, 5 Drawing Sheets

CANTING DEVICE FOR A SNOWBOARD BINDING AND METHODS

RELATED APPLICATIONS

This application claims the benefit of and priority to U.S. Provisional Application Ser. No. 60/705,627, filed Aug. 3, 2005, the contents of which are hereby incorporated by reference as if recited in full herein for all purposes.

FIELD

The present invention relates to snowboard bindings. More particularly, the present invention relates to methods and devices for altering a snowboard boot cant.

BACKGROUND

Snowboarding is a popular winter sport whose participants, generally called snowboarders, descend a snow covered mountain on a snowboard. A snowboarder is affixed to his or her snowboard by securing the boots worn by the snowboarder within snowboard bindings mounted to the snowboard.

One conventional type of snowboard binding is a freestyle soft boot style binding that typically includes a high-back plate, base and straps. The high-back plate consists essentially of an upright back piece extending from a heel portion of the binding and used by a snowboarder to apply pressure to the heel-side of the board.

The base provides a surface on which a snowboarder's boot is supported and has through-holes corresponding to threaded inserts in the snowboard through which fasteners extend to secure the binding to the snowboard. Standard snowboard binding-to-board mounting configurations include either three inserts or four inserts. A binding base can include a through-hole configuration to support mounting to a snowboard having a three-insert configuration, a four-insert configuration or both. The through-hole configuration of these conventional bindings allows for rotational adjustment of the binding relative to the snowboard.

The straps typically include two straps, an ankle strap and a toe strap, each having a ratcheting buckle that allows incremental tightening of the straps to secure the boot to the binding. When properly tightened, the ankle strap holds down the heel and the toe strap holds down the toe. Some strap bindings also have a third strap on the high-back plate commonly called a shin strap which gives additional support and aids in toe side turns.

As used herein, "snowboard binding" refers generally to the freestyle soft boot style binding as described above, which is used by most recreational riders, as opposed to the "click in" hard boot variety.

"Canting" or "cant" refers to the tilt, or angular deviation parallel, of the snowboarder's foot, as represented by the bottom surface of the boot, with respect to the snowboard's top surface, where the cant angle is measured transverse to an axis defined by an inner longitudinal edge of the binding base. The cant of a snowboard binding is independent from and should not be confused with the rotational adjustment of the binding with respect to the snowboard surface.

Canting a snowboarder's feet or boots with respect to the snowboard has proven desirable as a method of increasing the snowboarder's comfort when riding a snowboard by decreasing the amount of bending at the ankles and knees. More specifically, canting reduces a snowboarder's fatigue and improves a snowboarder's balance while snowboarding because the cant places the snowboarder in a more ergonomic position.

Canting has been achieved in a variety of ways. One known method involves mounting a flexible spacer or angled wedge-like element to the surface of the snowboard between the binding and the snowboard. Attaching the binding to the element results in the binding being angled with respect to the surface of the snowboard.

This method has several drawbacks. For example, the wedge-like element must be sufficiently thick and robust to compensate for pressures applied to it by the snowboarder during use of the snowboard. Also, a binding attached to the element is lifted or raised above the surface of the snowboard. Lifting the binding above the snowboard in this manner results in over-elevation of the boot with respect to the board. Over-elevation can reduce the snowboarder's perception of sensations vis-à-vis the board.

Another method involves a binding specifically configured to house a captive screw attached to a movable element. Adjustment of the screw in turn adjusts the element to provide canting of the boot. While this system may reduce the effect of over-elevation, as with most integrated canting systems, this canting system may only be used with one specially designed binding.

Another method involves forming angled footprints in the top surface of a board. However this method does not allow for adjustment of the canting angle. This method also does not provide a rigid connection to the board through the binding, which can result in a loss of power transmission from the snowboarder to the edge of the board. In addition, this method changes the geometry of the board, which can be undesirable.

It would be desirable to provide an approach that addresses these drawbacks.

SUMMARY

Overcoming many of the disadvantages of known methods for providing canting for snowboarding applications, canting devices for a snowboard binding and methods are described herein. The devices and methods allow a user to easily attach an attractive and light canting and boot support apparatus to an existing soft boot style binding to provide adjustable canting of a boot secured within the binding while reducing over-elevation of the boot with respect to the snowboard surface. More specifically, the device conforms to most existing strap bindings and conventional snowboard designs and allows adjustable cant of a snowboard boot secured by the binding without elevating the binding base with respect to the snowboard surface.

The canting device can be positioned generally within or overlaying the existing binding, and is thus configured to preserve many of the desirable characteristics of the existing binding. For example, the heel and toe lift characteristics found in most bindings are preserved by at least partially deforming a portion of the device to maintain a support surface having curved portions. Further, by allowing the binding base to remain flush with the surface of a snowboard and attaching the apparatus directly to the base, the feel of the original binding with respect to the snowboard and snow surface is also maintained.

According to one exemplary embodiment, the canting device can be included in a snowboard system that includes a snowboard and a snowboard binding mountable on the snowboard. The canting device can be an adjustable canting device positionable at least partially within the binding such that the binding is positioned between the snowboard and the adjustable canting device. The canting device can be configured to facilitate a cant of a snowboard boot secured in the binding relative to the binding and the snowboard.

In some implementations, the binding is mounted approximately flush with an outer surface of the snowboard.

In some implementations, the adjustable canting device is secured to the binding by a bracket having a unitary one-piece construction. The bracket includes openings corresponding to mounting openings in the binding through which mounting screws extend to secure the binding to the snowboard. The mounting screws are extendable through the openings in the bracket to secure the bracket to the binding.

In some implementations, the adjustable canting device can comprise a plate-like element having a toe portion, a heel portion, a center portion, an outer portion and an inner portion. At least one of the toe portion, the heel portion and the outer portion is raised or lowered relative to the center portion to adjust the inward cant of a snowboard boot when secured by the binding. In certain implementations, the plate-like element has a generally curved upper surface. In certain implementations, the outer portion is higher than the center portion and center portion remains stationary relative to the binding and the snowboard.

In some implementations, the adjustable canting device comprises a plate-like element coupled to a footing element via one or more rotatable screw mechanisms. A portion of the footing element engages the binding such that rotation of the rotatable screw mechanism urges deformation of the plate-like element to increase or decrease the inward cant of a snowboard boot when secured by the binding.

According to one embodiment, an adjustable canting device for use with a snowboard binding includes a plate-like element coupleable to a snowboard binding. The plate-like element is resilient over a working range. The device also includes at least one fastening device that is adapted to extend at least partially through the plate-like element and toward the binding. An inward cant of the plate-like element relative to the snowboard binding is adjustable by adjusting at least one of the plurality of screw mechanisms to move the plate-like element. In certain implementations, the plate-like element comprises a unitary one-piece construction.

In some implementations, the plate-like element can include a toe portion, a heel portion, an outer portion, an inner portion and a center portion. Adjustment of one of the fastening devices moves the toe portion, heel portion or outer portion relative to the center portion.

In some implementations, the device also includes a footing element coupled to the plate-like element via the at least one fastening device. The footing element is configured to facilitate adjustment of one or more portions of the plate-like element. In certain implementations, the footing element includes at least one elastomeric element in contact with a portion of the binding. The elastomeric element may have an inner portion with a thickness and an outer portion with a thickness. The thickness of the inner portion may be less than the thickness of the outer portion.

In some implementations, the device can include a bracket positionable between the plate-like element and the snowboard binding. The bracket can be configured to be secured to the snowboard and binding via screws threaded into threaded inserts in the board. The plate-like element can be mounted to the bracket.

In some implementations, the device can include a support pad that attaches to an upper surface of the plate-like element.

In another embodiment, an adjustable canting device for use with a snowboard binding comprises an at least partially resilient support plate coupleable to an upper surface of a snowboard binding. The support plate comprises a toe portion, a heel portion, an outer portion, an inner portion and a center portion. The device also includes at least a first fastening device that is adapted to extend at least partially through the support plate proximate the toe portion and toward the binding, and at least a second fastening device that is adapted to extend at least partially through the support plate element proximate the heel portion and toward the binding. The first fastening device is adjustable to adjust a cant of the toe portion of the support plate relative to the binding by deforming the support plate and the second fastening device is adjustable to adjust the heel portion of the support plate relative to the binding by deforming the support plate.

In some implementations, the device includes at least a third fastening device that is adapted to extend at least partially through the support plate proximate the outer portion and toward the binding. The third fastening device is adjustable to adjust a cant of the outer portion of the support plate relative to the binding by deforming the support plate.

A method of canting a snowboard boot for use with a snowboard binding can include positioning an adjustable canting device between the snowboard binding and the snowboard boot and adjusting the adjustable canting device such that the boot is inwardly canted relative to the snowboard binding. The method can also include adjusting an adjustable canting device and deforming a plate-like element of the adjustable canting device.

In some implementations, the adjustable canting device includes a footing coupled to a plate-like element via a threaded rod and the method includes rotating the threaded rod to raise or lower a portion of the plate-like element. In some implementations, the adjustable canting device includes a bracket and the method includes mounting the bracket to the binding. The method can include adjusting the adjustable canting device from a first cant angle to a second cant angle.

The snowboard binding can be secured to a snowboard by snowboard binding screws and the method can include removing the snowboard binding screws, positioning a mounting bracket on an upper surface of the snowboard binding, securing the bracket to the snowboard binding and resecuring the binding to the snowboard by tightening the snowboard binding screws to the snowboard and securing the adjustable canting device to the bracket.

The foregoing and other features and advantages will become more apparent from the following detailed description, which proceeds with reference to the accompanying figures.

DETAILED DESCRIPTION

Described herein are embodiments of a canting device for a snowboard binding and methods. Generally, the canting device can be positioned within and secured to a strap binding mounted to a snowboard. The canting device can include a plate that is configured to at least partially support a snowboard boot and selectively positionable to adjust the cant of the boot relative to the snowboard.

In illustrated embodiments, the plate is repositioned by resiliently deforming and/or moving portions of the plate such that they occupy different positions than when the plate is in a relaxed state.

In some embodiments, the plate has a partially curved support surface with elevated toe, heel and outer portions relative to center portion and inner portions. During adjustment of the cant of the boot, the basic curvature of the support surface is generally maintained and the toe and heel portions remain elevated relative to a center portion, e.g., the binding base plate, of the snowboard binding.

According to one embodiment, as illustrated in FIGS. 1-7, a snowboard system 10 includes a snowboard 20, a binding 30 and a canting device 50.

Figure 1A:
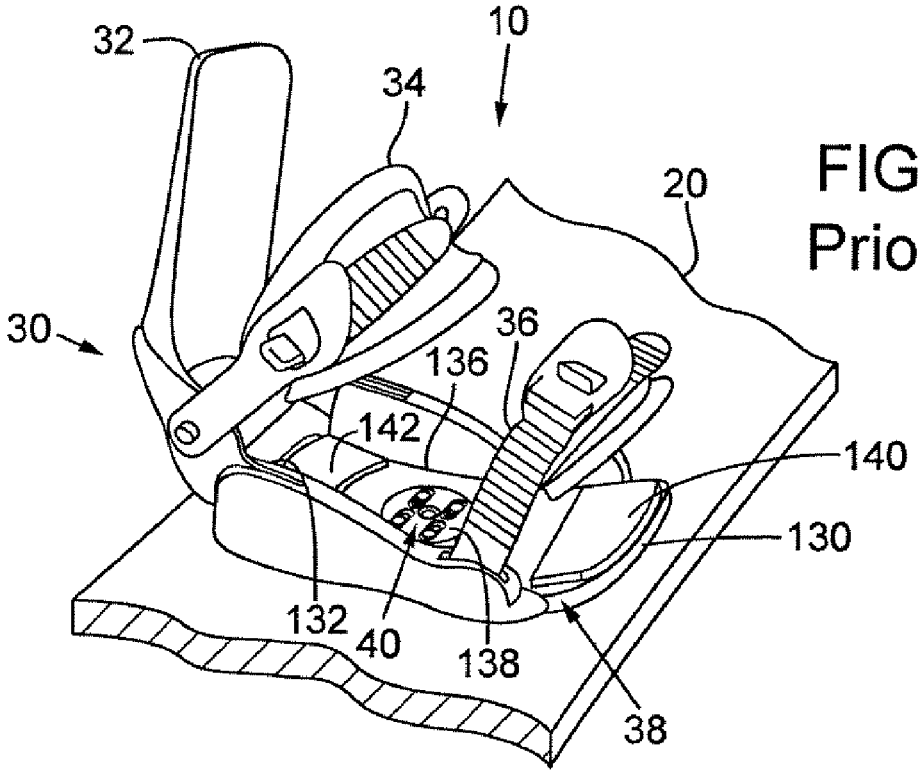
FIG. 1a Prior Art
FIG. 1*a* is a perspective view of a prior art snowboard system showing a portion of a snowboard and a binding.

Referring specifically to FIG. 1*a*, the snowboard 20 can be a conventional snowboard having an upper surface to which a binding can be attached and a lower surface opposite the upper surface which, when the snowboard is in use, is in contact with the ground. Formed in the upper surface of the snowboard 20 are threaded binding inserts (not shown) configured to receive mounting screws 24 to secure the binding 30 to the snowboard. The binding inserts can be threaded holes or grooves arranged in one of several configurations. For example, some conventional snowboards have multiple sets of four inserts in a square or rectangular pattern, multiple sets of three inserts in a triangular pattern or two elongate grooves.

Figure 7:
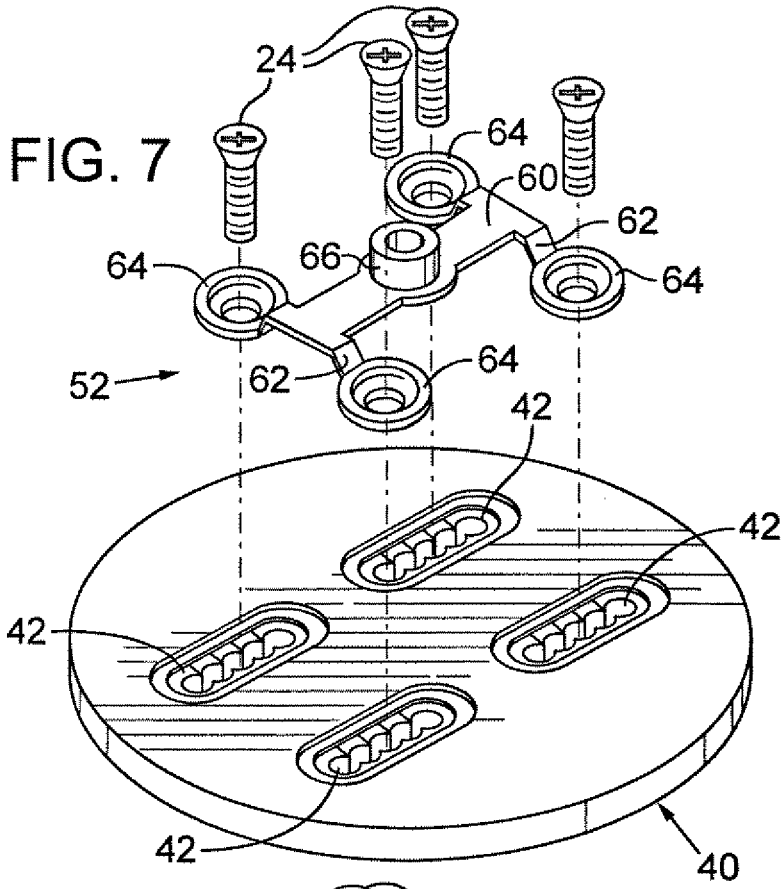
FIG. 7 is an exploded perspective view of a canting device mounting bracket having four arms and a base plate of a binding base having four corresponding sets of mounting openings.
Figure 8:
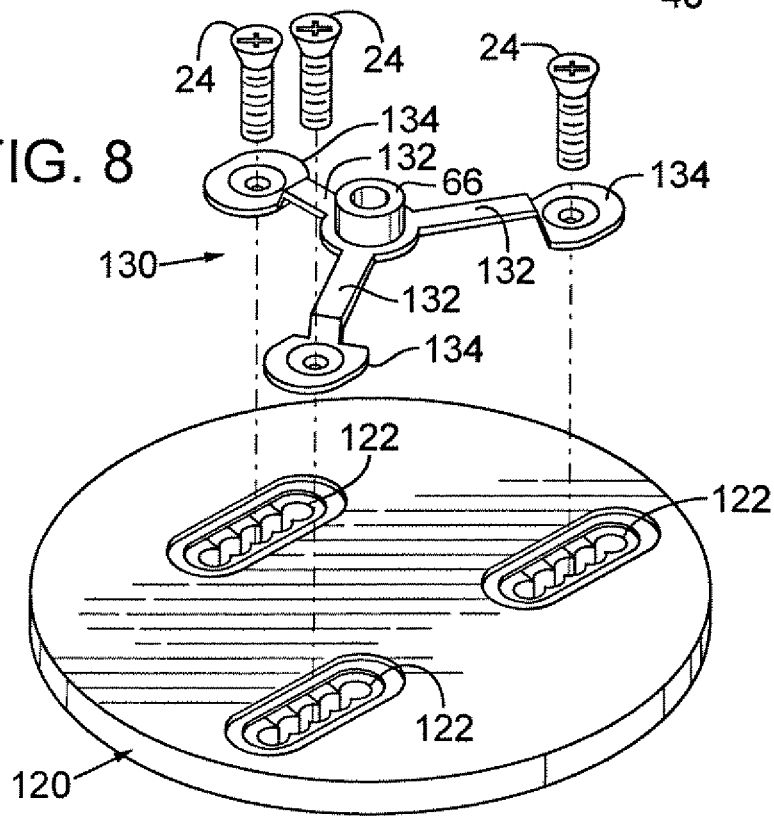
FIG. 8 is an exploded perspective view of a canting device mounting bracket having three arms and a base plate of a binding base having three corresponding sets of mounting openings.

The binding 30 can be a conventional strap binding having a high-back plate 32, one or more straps 34, 36 and a base 38. The base 38 can include a base plate 40 having multiple sets of openings corresponding to one of the several configurations of binding inserts formed in the snowboard 20. For example, as best shown in FIG. 7, a base plate 40 for use with a snowboard having four binding inserts includes four sets of openings 42. Similarly, as shown in FIG. 8, a base plate 120 for use with a snowboard having three binding inserts includes three sets of openings 122. As used herein, references to and general descriptions concerning base plate 40 and its features also apply to base plate 120 and its features.

The binding 30 is mountable to the snowboard 20 by inserting the mounting screws 24 through the sets of openings 42 and into the snowboard binding inserts and rotating the screws until the binding base 38 is tight against the upper surface of the snowboard. In conventional use, an upper surface of the base 38 is in contact with a snowboarder's boot (not shown) and acts to at least partially support the snowboarder.

Figure 1B:
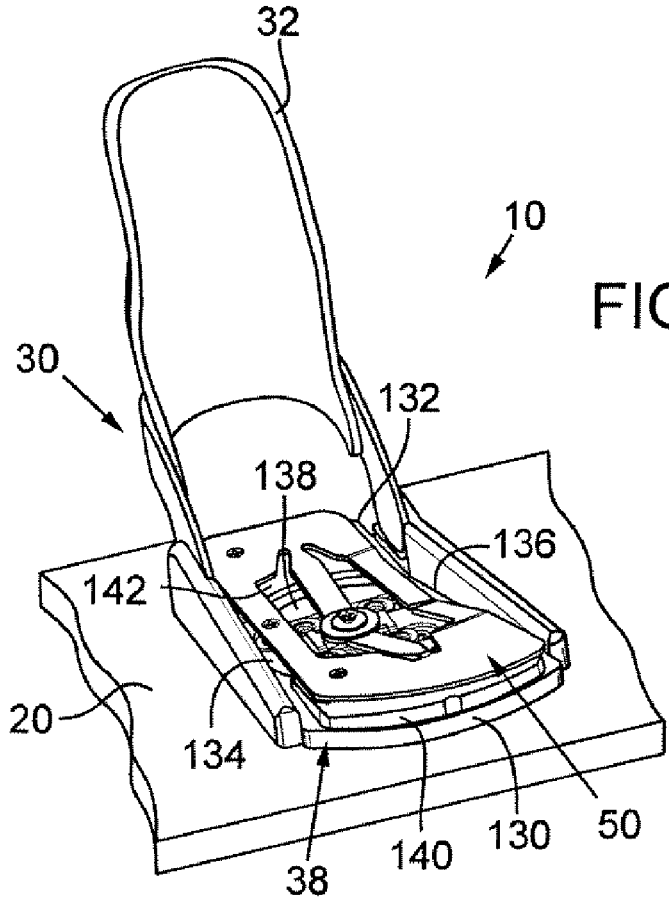
FIG. 1*b* is a perspective view of the snowboard system of FIG. 1*a* showing the new canting device.

As shown in FIGS. 1*a* and 1*b*, the base 38 is comprised of a toe portion 130, a heel portion 132, an outer portion 134, an inner portion 136 and a center portion 138 each corresponding to and at least partially supporting the same respective portions of the boot when secured in the binding 30 for conventional use of the binding. The toe and heel portions of conventional bases are typically raised in relation to the outer, inner and center portions by attaching toe and heel pads, such as toe and heel pads 140, 142, respectively, or by increasing the thickness of the base at the toe and heel portions, respectively. The boot and the foot of the snowboarder conform to a general curvature of the snowboard base resulting, in part, from the raised toe and heel portions to provide the snowboarder with greater feel and control of the snowboard.

Figure 2:
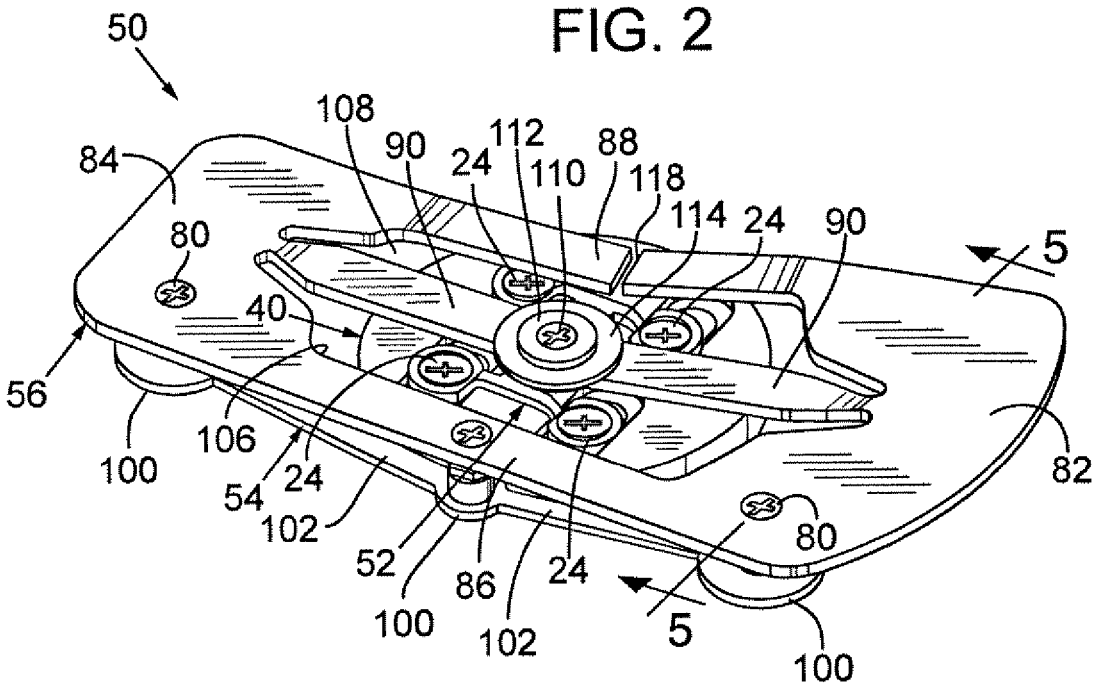
FIG. 2 is a perspective view of the canting device shown in FIG. 1*b* in a deformed state with the support pad removed.
Figure 3:
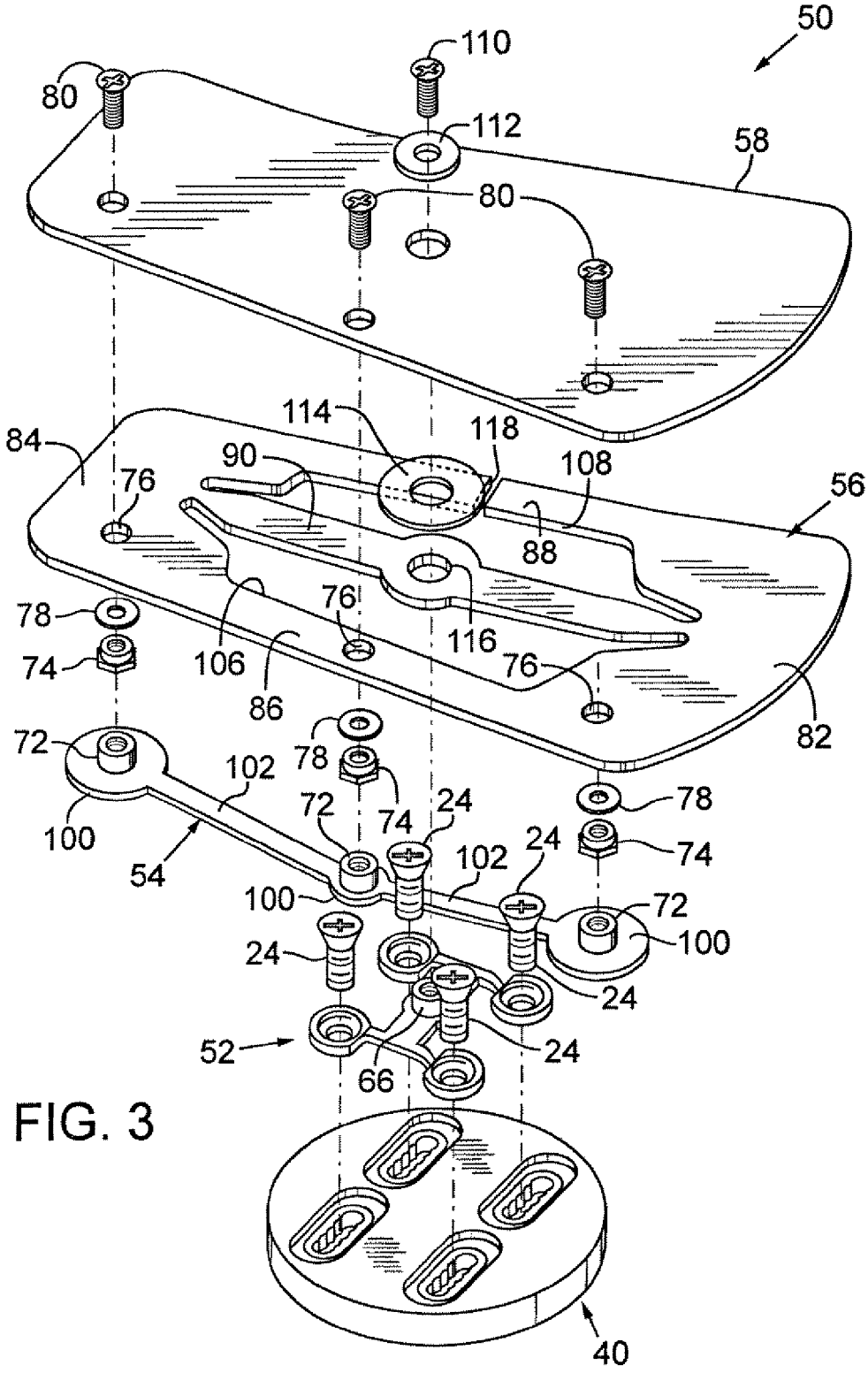
FIG. 3 is an exploded perspective view of the canting device shown in FIG. 1*b*.

As shown in FIG. 1*b*, the canting device 50 can be positioned within the binding 30 above the base 38 such that the base can remain tightened against the upper surface of the snowboard 20. Referring now to FIGS. 2 and 3, the canting device 50 can include a mounting bracket 52, a footing plate 54, a support plate 56 and a support pad 58.

The mounting bracket 52 includes a central portion 60 from which multiple arms 62 extend (see FIG. 7). The arms 62 include eyelets 64 positioned at ends of the arms away from the central portion 60. The eyelets 64 are alignable with the sets of openings 42 in the base plate 40 of the binding 30 and consequently, the threaded binding inserts in the snowboard 20. When aligned with the sets of openings 42 and the threaded binding inserts, the mounting screws 24 can be inserted through openings in the eyelets 64, the sets of openings in the binding and into the threaded binding inserts such that tightening the screws in the snowboard 20 secures the mounting bracket 52 to the base plate 40.

As shown in FIG. 7, the mounting bracket 52 includes four arms 62 and four eyelets 64 to be mounted to base plate 40 and a snowboard having four binding inserts. Similar to the mounting bracket 52, in one embodiment, as shown in FIG. 8, a mounting bracket 130 includes three arms 132 and three eyelets 134 to be mounted to base plate 120 and a snowboard having three binding inserts. As used herein, references to and general descriptions concerning mounting bracket 52 and its features also apply to mounting bracket 130 and its features.

As will be described below, when the canting device 50 is coupled to the binding 20, forces applied to the support plate 56 of the canting device by the user can be transmitted directly to the board 20 through use of the mounting bracket 52 to preserve the natural feel of the binding. When tightened to the base plate 40, the mounting bracket 52 facilitates force transfer applied to the support plate 56 to the threaded inserts 24 in the board and thus directly to the board. Thus the mounting bracket 52 assists in preserving the feel and perception between the snowboarder, the binding 30 and the snowboard 20. With some base plates having recessed sets of openings 42, as shown in the illustrated embodiments, the arms 62 can be bent or curved (as shown, e.g., in FIG. 8) to allow the central portion 60 to sit flush with the base plate.

In some implementations, threaded holes can be formed in the binding base plate 40 such that support plate 56 can be mounted directly to the binding base plate 40 without the use of a mounting bracket. In this configuration, forces applied to the support plate 56 would be transmitted directly to the base plate 40 and thus indirectly to the board 20.

The central portion 60 of the mounting bracket 52 can include one or more mounts 66 each having an internally threaded hole to facilitate attachment of the support plate 54, footing plate 56 and support pad 58. In some embodiments, the mount is formed as one piece with the bracket 52, and in other embodiments, each mount 66 includes a nut, such as a Model CLA-M6-1 self-clinching nut manufactured by Penn Engineering, Inc. of Danboro, Pa., press-fit into an opening (not shown) in the central portion 60.

Figure 4:
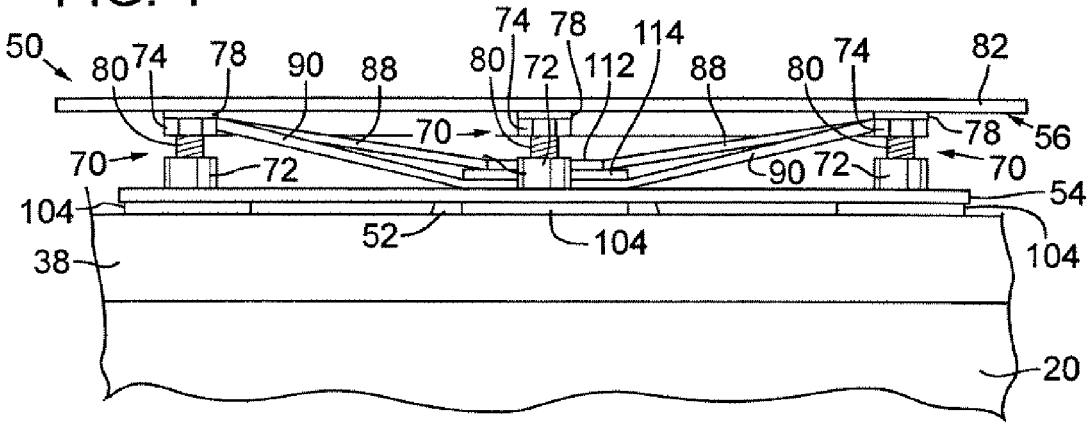
FIG. 4 is an elevation side view illustrating the canting device shown in FIG. 2 secured to a binding base and snowboard.

The support plate 56 and the footing plate 54 are coupled to each other and movable relative to each other via multiple fastener, or screw, mechanisms 70 (see FIG. 4). In some embodiments, each fastener mechanism 70 can comprise a fixed nut element, a rotatable nut element, a washer and a fastener.

The fixed nut element can be formed in and integral with the footing plate 54. Alternatively, as shown in the illustrated embodiments, the fixed nut element can be a nut 72, such as the Model CLA-M6-1 self-clinching nut manufactured by PennEngineering, Inc. that is press-fit into openings (not shown) in the footing plate 54. The fixed nut 72 includes internal threads and is configured to remain fixed relative to the footing plate 54.

The rotatable nut element can be a nut 74, such as a Model F-M6-3 self-clinching flush fastener also manufactured by PennEngineering, Inc. The nut 74 has a cylindrical portion that is insertable into and axially rotatable within one of multiple fastener mechanism openings 76 formed in the support plate 56 and a hexagonal head or stop that has a circumference greater than a circumference of this opening. A washer 78 made from a high-strength, durable material, such as stainless steel or a hardened plastic, can be positionable between a lower surface of the support plate 56 and the stop of the nut 74. As will be described in more detail below, the washer 78 is configured to reduce grinding or friction between the stop and the support plate during adjustment of the canting device 50.

The fastener mechanisms 70 also include fasteners, such as screws 80, that extend through the fastener mechanism openings 76 in the support plate 56 and the washer 78. The screw 80 is threaded through the rotatable nut 74 and threadably engages the fixed nut 72 to couple the footing plate 54 and the support plate 56.

The screw 80 can be a countersunk screw having a head with a tapered portion. The screw 80 is threaded through the rotatable nut 74 until an edge of the tapered portion is tightened against a chamfered edge of the cylindrical portion of the rotatable nut to secure the nut to the screw. Consequently, rotation of the screw 80 correspondingly rotates the rotatable nut 74 such that the cylindrical portion coaxially rotates within the opening 76.

In the illustrated embodiments, the canting device 50 includes three fastener mechanisms 70. In other embodiments, however, the canting device 50 can include fewer or more than three fastener mechanisms 70.

When secured to a snowboard binding 30, the support plate 56 is positioned over the upper surface of the binding 30 such that, instead of the upper surface of the binding being in contact with a snowboard boot, an upper surface of the support plate (more precisely, its attached support pad 58) is in contact with the snowboard boot and at least partially supports a snowboarder using the snowboard system 10. The support plate 56 is comprised of a toe portion 82, heel portion 84, outer portion 86, inner portion 88 and center portion 90 that, like the upper surface of the binding, correspond to and at least partially support the same respective portions of the boot when secured in the binding 30.

Each fastener mechanism opening 76 is positioned in at least one of the toe portion 82, heel portion 84 and outer portion 86 of the support plate 56. In the illustrated embodiments, the support plate 56 includes three fastener mechanism openings 76 each positioned in one of the toe, heel and outer portions 82, 84, 86, respectively.

As best shown in FIG. 2, the footing plate 54 is positioned between the support plate 56 and the binding base 38, and base plate 40, and comprises a plate-like structure having multiple footings 100 connected by elongate arms 102. Each footing 100 can include one or more fixed nut elements. For example, each footing 100 can include an opening (not shown) configured to receive a fixed nut 72. The footings 100 are spaced apart such that the fixed nut elements are axially alignable with the fastener mechanism openings 76 in the support plate 56 to allow insertion of the fastener mechanisms 70.

As can be recognized, when coupled to the support plate 56, the footing plate 54 is positioned under the toe, heel and outer portions 82, 84, 86, respectively, of the support plate 56. Further, as will be described below, when the canting device 50 is secured to the binding 30, a lower surface of each footing 100 is contactable with one of the toe, outer, or heel portions 130, 134, 132, respectively, of the binding base 38. Such intimate contact with the toe, outer and heel portions of the binding base 38 helps to preserve the feel and perception between the snowboarder and the binding 30, and thus the snowboard 20. The footings 100 can have a width significantly greater than that of the elongate arms 120 for increased stability.

In some embodiments, the lower surface of each footing 100 can include a resilient elastomeric element 104 to protect the binding base 38 from scuffing or other damage and to provide shock-absorption effects. To maintain coaxial alignment between the fastener mechanism opening 76, the rotatable nut 74, the screw 80 and the fixed nut 72 of the fastener mechanism 70 over a range of different canting angles, in some implementations, the elastomeric element 104 can have an increasing thickness from an inner to an outer portion, for example, a wedge shape (see FIG. 6). In other implementations, for example, the elastomeric element 104 can have a step separating an inner portion with a first thickness from an outer portion with a second thickness greater than the first thickness. Such coaxial alignment facilitates cant adjustment without binding the fasteners, e.g., the screws 80, of the fastener mechanisms 70 and promotes direct transfer of forces from the foot of a snowboarder to the binding 30. Further, in the event that a fastener is disconnected from a fixed nut 72, general coaxial alignment between the fastener mechanisms 70 and the fixed nuts 72 makes reattachment of the fastener to the fixed nut easier.

Coaxial alignment between the fastener mechanism opening 76 and the various components of the fastener mechanism can also be aided by allowing the rotatable nut 74 to slightly laterally move within the fastener mechanism opening. This can be accomplished by dimensioning the fastener mechanism opening 76 such that its diameter is slightly larger than an outer diameter of the cylindrical portion of the nut 74.

Further regarding the support plate 56, in some embodiments, it comprises a unitary, one-piece plate-like structure, i.e., a flat or non-flat element with a thickness substantially smaller than its major surface dimensions, and made of a flexible, durable and resilient material, such as, but not limited to, forged, rolled, or cast aluminum and steel, or a polymer, such as fiberglass, carbon or Kevlar reinforced plastics. The support plate 56 can be configured such that it is resilient over a working range. The support plate 56 can include an elongate opening 106 that separates the outer portion 86 from the central portion 90 and an elongate opening 108 that separates the inner portion 88 from the central portion. These openings allow the central portion 90 to be tightened against the base plate 40 while the inner and outer portions remain free to move relative to the base plate, and thus base 38.

The central portion 90 comprises an elongate web having narrowing ends at which it is connected to the toe and heel portions, 82, 84, respectively. The center portion 90 includes an opening 116 corresponding to the mount 66 of the mounting bracket 52. The support plate 56 is attached to the mounting bracket 52 by inserting a fastener, such as screw 110, through the opening 116 and into the mount 66, and tightening the screw.

In some embodiments, the support plate 56 can be positioned between a washer 112 and a spacer 114 combination and the mounting bracket 52 to facilitate tightening of the central portion 90 of the support plate 56 flush against the central portion 60 of the mounting bracket 52. The openings 116 and a central opening in the spacer 114 are larger than an outer perimeter of the mount 66. The washer 112 is positionable between the spacer 114 and the support plate 56. Tightening the screw 110 causes the washer 112 to press down on the spacer 114, which in turn urges the central portion 90 of the support plate 56 to be mounted flush with an upper surface of the central portion 60 of the mounting bracket 52.

Although a spacer and a washer are shown to facilitate attachment of the support plate 56 to the mounting bracket 52, it is recognized that other configurations are possible to mount the support plate 56 flush with the mounting bracket 52, such as, for example, other standardized and/or specialized fastener arrangements.

As shown in the illustrated embodiments, the canting device 50 also includes a support pad 58 positioned above the support plate 56 to at least partially support and cushion the snowboarder's boots. The support pad 56 includes a uniform upper surface that aids in preventing snow and ice accumulation on the pad. Further, the material of which the support pad 56 is made and/or the texture of the upper surface of the pad can promote a high coefficient of friction to reduce slippage of the boot relative to the pad.

In some embodiments, the support pad 58 can be made from a single layer of a durable, low-density material, such as foam rubber, PVC foam, molded foam or plastic, or from multiple layers of similar materials.

The support pad 58 can be secured to the upper surface of the support plate 56 by an adhesive between the pad and support plate. In some embodiments, the support pad 58 includes holes corresponding with the fastener mechanism openings 76 and opening 116 in the support plate 56.

As can be recognized from the foregoing, installation of the canting device 50 to an existing binding can be accomplished in several ways. In one implementation, for example, referring to FIGS. 2 and 3, the canting device 50 can be installed to existing binding 30 by attaching the mounting bracket 52 to the binding base plate 40 using conventional binding mounting bolts, or screws 24. The central portion 60 of the mounting bracket 52 sits generally flush with an upper surface of the base plate to help maintain the natural feel of the binding by minimizing the spacing between the central portion 90 of the support plate 56 and an upper surface of the binding base 38. The nuts 74, washers 78 and screws 80 of the fastener mechanisms 70 can then be coupled to the support plate 56.

The footing plate 54 and the support plate 56 are coupled by threadably engaging the screws 80 with the fixed nuts 72 in the footing plate. In some implementations, the screws 80 can remain held within the fixed nuts 72 even after threadable engagement between the screws and the fixed nuts ceases due to over-rotation of the screws relative to the fixed nuts through use of a tapered chamfer formed in the fixed nuts. The support plate 56, footing plate 54 and fastener mechanisms 70 assembly can then be positioned within the binding 30 on the upper surface of the binding plate 38 such that the opening in the central portion 90 of the support plate aligns with the mount 66 of the mounting bracket 52. In this position, the support plate 56, being in its original configuration, has a substantially flat upper surface and is angled with respect to the binding plate 38. In other words, the footings 100 of the footing plate 54 and a lower surface of the inner portion 88 of the support plate 56 are in contact with the upper surface of the binding plate 38 such that a gap exists between the outer portion 86 of the support plate and the binding plate, and a portion of the toe and heel portions 82, 84 of the support plate and the binding plate.

The mounting screw 110 is then inserted through washer 112, spacer 114 and central portion opening 116 into the mount 66 and tightened to secure the support plate 56, footing plate 54 and fastener mechanisms 70 to the binding 30. As the mounting screw 110 is tightened to cause the spacer to translationally descend along its central axis, the spacer 114 deforms the support plate 56 as shown in FIG. 2 by applying a downward pressure to the central portion 90 of the support plate. The tightening force urges the central portion 90 of the support plate 56 axially downward until it is flush with and tightened against the central portion 60 of the mounting bracket 52. The narrowed ends of the central portion 90 of the support plate having a reduced width compared to intermediate sections of the central portion to help facilitate deformation of the central portion.

As best shown in FIGS. 2 and 4-6, when coupled to the binding 30, at least a portion of the central portion 90 of the support plate 56 is at approximately the same elevation as the inner portion 88 of the support plate and at a lower elevation than the outer portion 86 of the support plate. Further, the footings 100 and fastener mechanisms 70 positioned proximate the toe and heel portions 82, 84 cause at least a portion of toe and heel portions to remain at a higher elevation than the central portion 90. With the support plate 56 deformed in this manner, the originally flat upper surface of the support plate now has portions that are generally curved to mimic the natural curvature of the binding base 38.

The support pad 58 can then be secured to the upper surface of the support plate 56 by applying a pressure to, or otherwise activating, the adhesive between the support pad and support plate. The support pad 58 can also be at least partially secured by tightening washer 112 against the pad.

Upon installation of the canting device 50, the cant of the support plate 56 can be adjusted by adjusting one or more of the fastener mechanisms 70, e.g., by rotating them. In the illustrated embodiments, the screws 80 of the fastener mechanisms 70 can be Phillips head screws that can be rotated by using a conventional Phillips head screwdriver. In some embodiments, the screws 80 can be slotted head screws that are rotated by a conventional slotted screwdriver, hex socket screws that are rotated by a conventional hex wrench, hex head screws that are rotated by a conventional ratchet or torque wrench, or other similar fastener and fastening tool (e.g. Torx® Fasteners)

Being threadably engaged with the fixed nuts 72 in the footing plate 54, rotation of the screws 80 causes the screws to either raise or lower along their axes with respect to the fixed nuts depending on the direction of rotation of the screws.

As the screws 80 are raised, the rotating nuts 74, being coupled with the heads of the screws, are also raised and contact the lower surface of the support plate 56 via washers 112 to apply an upward directed pressure to the plate. Depending on which fastener device 50 is adjusted, the upward directed pressure causes one of the toe, heel or outer portions, 82, 84, 86, of the support plate to raise with respect to the central and inner portions of the support plate thus deforming the support plate and increasing the cant.

As shown in FIG. 4, the heel, toe and outer portions 82, 84, 86 are raised with respect to the inner portion 90. Further, as the heel, toe and/or outer portions 82, 84, 86 are raised or lowered, at least a portion of the center portion 90 remains lower than and stationary with respect to the heel, toe and outer portions.

Figure 5:
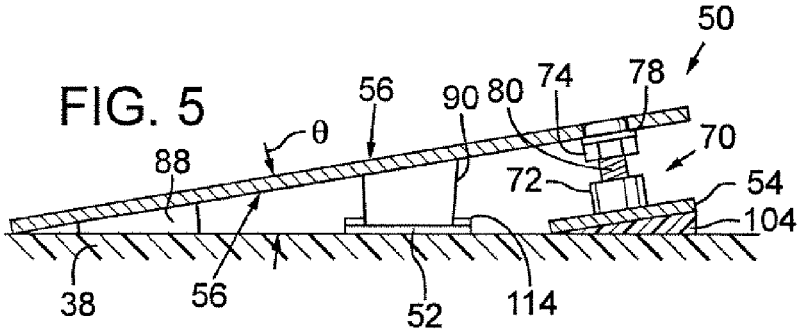
FIG. 5 is an elevation sectional front view taken along the line 5-5 in FIG. 2 illustrating the canting device shown in FIG. 2 at a first cant angle and secured to a binding base.

Referring to FIG. 5, the screw 80 is raised such that the support plate 56 is canted at a cant angle of θ degrees with respect to the upper surface of the binding base 38 and the snowboard (not shown).

As the screws 80 are lowered, the resiliency of the support plate 56 urges the plate towards its original shape thus causing the respective portions of the support plate to lower and the cant to decrease. In some embodiments, the heads of the screws 80 may contact an upper surface of the support plate 56 to apply a downward force to the plate 56 to assist in lowering the plate.

Figure 6:
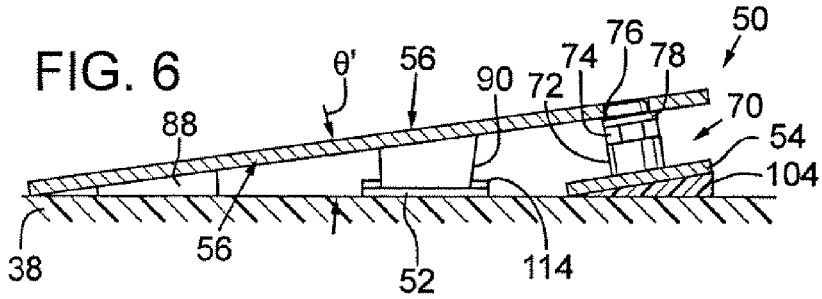
FIG. 6 is an elevation sectional front view taken along the line 5-5 in FIG. 2 that is similar to FIG. 5 but shows the canting device at a second cant angle.

Referring to FIG. 6, the screw 80 has been lowered in relation to the position of the screw in FIG. 5 such that the support plate 56 is canted at a cant angle of θ' degrees with respect to the upper surface of the binding base 38 and the snowboard (not shown), where θ' is less than θ. The support plate 56 can also be adjusted to any number of angles between θ and θ'.

As described herein, canting the support plate 56 can include increasing and/or decreasing the toe and heel lift of the support plate relative to the binding 30 or snowboard 20. Furthermore, the toe and heel lift can be adjusted by raising and lowering the screws 80 associated with the toe and heel portions, respectively, by rotating the screws in the same manner as described above.

The inner portion 88 of support plate 56 can include a gap 118 separating the inner portion into two sections. As the canting device 50 is adjusted to increase the cant of the support plate 56 relative to the binding 30 and snowboard 20, the gap 118 allows the sections of the inner portion 88 to move toward each other to prevent buckling of the support plate. Similarly, as the cant is decreased by adjustment of the canting device 50, the gap 118 allows the sections to move away from each other to reduce strain on the support plate 56.

In some implementations, the fastener mechanisms 70 can be adjusted such that the toe and heel portions 82, 84, respectively, of the support plate 56 are elevated above the center portion 86 of the support plate to achieve a "cushioned" ride during use of the snowboard system. Adjustment of the fastener mechanisms 70 increases or decreases a distance defined between the support plate 56 and the respective footings 100 along the axes of the fasteners 80 of the respective fastener mechanisms 70. The fastener mechanisms 70 corresponding to the toe, heel and outer portions 82, 84, 86, respectively, are adjusted such that the respective distances between the support plate 56 and the footings 100 of the toe and heel portions 82, 84, respectively, are greater than the distance between the support plate and the footing 100 of the outer portion.

During use, the footings 100 corresponding to the toe and heel portions 82, 84, respectively, remain in contact with the binding base 38 such that the toe and heel portions remain relatively stationary. In contrast, the footing 100 corresponding to the outer portion 86 does may not remain in contact with the binding base, i.e., a gap can exist between the footing and the base, such that downward pressure on the support plate causes the outer portion 86 of the support plate 56 to bend slightly such that the outer portion is allowed to move downward a distance less than or equal to the distance between the gap. This movement of the outer portion during use translates into a cushioned feel on the snowboarder.

A user of the canting device may desire no canting or a minimal cant of the boot, in which case the user can remove the footing plate 54 so that upon installation of the support plate, the lower surface of the support plate lays generally flush with an upper surface of the binding base 38.

Although only one binding with an associated canting device are shown in the illustrated embodiments, of course, the snowboard system can optionally include a second binding with an associated second canting device such that each canting device can be individually adjusted to adjust the cant of the respective boots secured to the bindings. Accordingly, a snowboarder's left foot can be canted at an angle different than or the same as the cant angle of the snowboarder's right foot.

In addition to snowboards, the described approach could be used with other sporting equipment, such as skis, water skis, wakeboards, windsurfers, sailboards, surfboards, skateboards, etc.

All patent and non-patent literature referred to herein is hereby incorporated by reference for all purposes as if listed in its entirety herein.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims.

The invention claimed is:

1. A binding system, comprising:

a snowboard binding mountable on the snowboard, the binding being configured to receive and secure a snowboard boot; and an adjustable canting device comprising a support plate positionable at least partially within the binding such that the binding is positioned between the snowboard and the adjustable canting device;

wherein the adjustable canting device is configured to selectively cant a snowboard boot relative to the binding and the snowboard when the snowboard boot is secured in the binding;

and wherein the support plate comprises a plurality of independently deformable portions, each portion being coupled to a fastener mechanism arranged to adjustably deform the portion and thereby change the elevation of the portion above the binding to allow for independent adjustment of each portion.

2. The system of claim 1, wherein the adjustable canting device is secured to the binding by a bracket having openings corresponding to mounting openings in the binding through which mounting fasteners of the fastener mechanism extend to secure the binding to the snowboard, and wherein the mounting fasteners are fastenable through the openings in the bracket to secure the bracket to the binding.

3. The system of claim 2, wherein the bracket comprises a mount adapted to secure the canting device to the bracket.

4. The system of claim 1, wherein the adjustable canting device comprises support plate having a toe portion, a heel portion, an outer portion and an inner portion, and wherein at least one of the toe portion, the heel portion and the outer portion is raised or lowered relative to the inner portion to adjust the inward cant of a snowboard boot when secured by the binding.

5. The system of claim 1, wherein the adjustable canting device comprises a support plate coupled to a footing element via one or more rotatable screw mechanisms, and wherein a portion of the footing element bears against the binding such that rotation of the rotatable screw mechanism deforms the support plate to increase or decrease the inward cant of a snowboard boot when secured by the binding.

6. An adjustable canting device, comprising:

a support plate coupleable to a snowboard binding base, wherein the support plate is resilient over a working range wherein the support plate comprises a plurality of independently deformable portions; and one or more fastener mechanisms each coupling a portion of the support plate to the binding, and each fastener mechanism being adjustable to deform a portion and thereby change the elevation of the portion relative to the binding to allow for independent adjustment of the portion relative to another portion of the support plate, wherein an inward cant of the support plate relative to the snowboard binding is adjustable by adjusting the at least one fastener mechanism to change the elevation of the support plate above the binding.

7. The device of claim 6, further comprising a footing element coupled to the support plate via a fastener mechanism, the footing element being configured to facilitate adjustment of a portion of the support plate.

8. The device of claim 7, wherein the footing element comprises at least one elastomeric element in contact with a portion of the binding.

9. The device of claim 6, wherein the support plate comprises a unitary one-piece construction.

10. The device of claim 6, further comprising a bracket positionable between the support plate and the snowboard binding and configured to be secured to the snowboard binding base, wherein the support plate is mountable to the bracket.

11. The device of claim 6, further comprising a support pad attachable to an upper surface of the support plate.

12. The device of claim 6, wherein the support plate comprises a toe portion, a heel portion, an outer portion, an inner portion and a center portion, and wherein adjustment of one of the fastener mechanisms moves at least one of the toe portion, the heel portion and the outer portion relative to the center portion.

13. The device of claim 12, wherein at least a portion of an upper surface of the toe portion of the support plate, a portion of an upper surface of the outer portion of the support plate, and a portion of an upper surface of the heel portion of the support plate remain higher than an upper portion of the center portion of the support plate.

14. The device of claim 6, wherein the at least one fastener mechanism comprises a first fastener mechanism proximate a toe portion of the support plate, a second fastener mechanism proximate an outer portion of the support plate and a third fastener mechanism proximate a heel portion of the support plate, and wherein adjusting the first fastener mechanism adjusts the cant of the toe portion, adjusting the second fastener mechanism adjusts the cant of the outer portion and adjusting the third fastener mechanism adjusts the cant of the heel portion.

15. An adjustable canting device, comprising:

a support plate coupleable to a snowboard binding base, wherein the support plate is resilient over a working range: and at least one fastener mechanism adapted to extend at least partially through the support plate and toward the binding, wherein an inward cant of the support plate relative to the snowboard binding is adjustable by adjusting the at least one fastener mechanism to move the support plate further comprising a bracket positionable between the support plate and the snowboard binding and configured to be secured to the snowboard binding base, wherein the support plate is mountable to the bracket; and wherein the bracket comprises a unitary one-piece construction having a set of first openings corresponding to mounting apertures in a base plate included in the snowboard binding base and at least a second opening configured to facilitate mounting of the support plate to the bracket.

16. An adjustable canting device, comprising:

a support plate coupleable to a snowboard binding base, wherein the support plate is resilient over a working range; and at least one fastener mechanism adapted to extend at least partially through the support plate and toward the binding, wherein an inward cant of the support plate relative to the snowboard binding is adjustable by adjusting the at least one fastener mechanism to move the support plate;

wherein the support plate comprises a toe portion, a heel portion, an outer portion, an inner portion and a center portion, and wherein adjustment of one of the fastener mechanisms moves at least one of the toe portion, the heel portion and the outer portion relative to the center portion; and wherein the center portion comprises an elongate web coupled at a first end to the toe portion and at a second end to the heel portion, and wherein the support plate comprises a first elongate opening extending the length of a first side of the center portion and a second elongate opening extending the length of a second side of the center portion, and wherein the first elongate opening separates the center portion from the outer portion and the second elongate opening separates the center portion from the inner portion.

17. An adjustable canting device, comprising:

a support plate coupleable to a snowboard binding base, wherein the support plate is resilient over a working range; and at least one fastener mechanism adapted to extend at least partially through the support plate and toward the binding, wherein an inward cant of the support plate relative to the snowboard binding is adjustable by adjusting the at least one fastener mechanism to move the support plate;

wherein the support plate comprises a toe portion, a heel portion, an outer portion, an inner portion and a center portion, and wherein adjustment of one of the fastener mechanisms moves at least one of the toe portions, the heel portion and the outer portion relative to the center portion;

wherein the center portion comprises an elongate web coupled at a first end to the toe portion and at a second end to the heel portion, and wherein the plate support plate comprises a first elongate opening extending the length of a first side of the center portion and a second elongate opening extending the length of a second side of the center portion, and wherein the first elongate opening separates the center portion from the outer portion and the second elongate opening separates the center portion from the inner portion; and further comprising a footing element comprising a mount adapted to receive a portion of the fastener mechanism, wherein adjustment of the fastener mechanism causes the fastener mechanism to raise or lower with respect to the mount.

18. An adjustable canting device, comprising:

a support plate coupleable to a snowboard binding base, wherein the support plate is resilient over a working range; and at least one fastener mechanism adapted to extend at least partially through the support plate and toward the binding, wherein an inward cant of the support plate relative to the snowboard binding is adjustable by adjusting the at least one fastener mechanism to move the support plate:

wherein the support plate comprises a toe portion, a heel portion, an outer portion, an inner portion and a center portion, and wherein adjustment of one of the fastener mechanisms moves at least one of the toe portion, the heel portion and the outer portion relative to the center portion; and wherein the support plate comprises a first elongate opening separating the center portion and the outer portion, and a second elongate opening separating the center portion and the inner portion.

19. An adjustable canting device for use with a snowboard binding, comprising:

an at least partially resilient support plate coupleable to an upper surface of a snowboard binding, the support plate comprising a toe portion, a heel portion, an outer portion, an inner portion and a center portion; and at least a first fastener mechanism adapted to extend at least partially through the support plate proximate the toe portion and toward the binding, and at least a second fastener mechanism adapted to extend at least partially through the support plate element proximate the heel portion and toward the binding;

wherein the first fastener mechanism is adjustable to adjust a cant of the toe portion of the support plate relative to the binding by deforming the support plate and the second fastener mechanism is adjustable to adjust the heel portion of the support plate relative to the binding by deforming the support plate;

wherein the deformation results in a change in the spacing of a gap between the support plate and the binding.

20. The device of claim 19, further comprising at least a third fastener mechanism adapted to extend at least partially through the support plate proximate the outer portion and toward the binding, wherein the third fastener mechanism is adjustable to adjust a cant of the outer portion of the support plate relative to the binding by deforming the support plate.

21. A cantable binding system, comprising:

a binding base mountable on a board for a sports activity;

a support plate comprising a toe portion, a heel portion, an outer portion, and an inner portion, the support plate being coupled to and above the base, the support plate sized and shape to receive a sports boot and to extend from a heel to a toe portion of the boot;

a plurality of spaced-apart fastener mechanisms coupled to and extending between the base and the support, at least one fastener mechanism disposed at a heel portion position, and at least one fastener mechanism disposed at a toe portion position, each fastener mechanism providing height adjustability of the support plate at its corresponding position thereby to provide canting of a user's boot and/or foot relative to a board on which the system is mounted; and the heel and toe portions being independently deformable from each other by adjustment of their corresponding fastener mechanism to change the elevation of the portions above the binding to allow for independent adjustment of each of the heel and toe portions.

22. The system of claim 21 wherein at least one of the fastener mechanisms at the toe and heel positions is also at an outer portion position.

23. The system of claim 21 further comprising a footing associated with each fastener mechanism position and coupled to and disposed between a fastener mechanism and the base plate.

24. The system of claim 21 wherein the support plate is resilient so as to allow resilient deformation of the support plate at one position relative to another.

25. The system of claim 21 wherein it is sized and shaped for mounting on a snowboard and for receiving a snowboard boot.

26. The system of claim 21 further comprising a shock absorption element disposed under and operatively coupled to the support plate.

27. The system of claim 26 wherein the shock absorption element is coupled to a fastener mechanism.

28. The system of claim 26 wherein the shock absorption element comprises a toe or heel pad.

29. The system of claim 21 further comprising a high back plate extending upwardly from and coupled to the heel portion for receiving the raised, rear upper of a sports boot.

30. The system of claim 21 wherein the support plate comprises a resiliently deformable, unitary one-piece construction.

31. The system of claim 21 wherein the fastener mechanism at the heel or toe portion allows for independent adjustment of the height of the support plate above the base at the heel portion or toe portion.

32. The system of claim 21 wherein the support plate includes a center portion that is resiliently deformable relative to the outer portion and the fastener mechanisms are arranged so as to allow the center portions to be adjusted to a lower height relative to the outer portion.

* * * * *